US011994008B2

(12) United States Patent
Anthony et al.

(10) Patent No.: US 11,994,008 B2
(45) Date of Patent: May 28, 2024

(54) LOADED PERFORATING GUN WITH PLUNGING CHARGE ASSEMBLY AND METHOD OF USING SAME

(71) Applicant: GR Energy Services Management, LP, Sugar Land, TX (US)

(72) Inventors: James William Anthony, Missouri City, TX (US); Cameron Michael Bryant, Sugar Land, TX (US); Vadim Akhmadikin, Sugar Land, TX (US)

(73) Assignee: GR Energy Services Management, LP, Sugar Land, TX (US)

( * ) Notice: Subject to any disclaimer, the term of this patent is extended or adjusted under 35 U.S.C. 154(b) by 0 days.

(21) Appl. No.: 17/585,446

(22) Filed: Jan. 26, 2022

(65) Prior Publication Data

US 2022/0145732 A1 May 12, 2022

Related U.S. Application Data

(63) Continuation-in-part of application No. 17/366,884, filed on Jul. 2, 2021, which is a continuation of (Continued)

(51) Int. Cl.
*E21B 43/117* (2006.01)
*E21B 43/119* (2006.01)

(52) U.S. Cl.
CPC ..... *E21B 43/117* (2013.01); *E21B 43/119* (2013.01)

(58) Field of Classification Search
CPC .... E21B 43/116; E21B 43/117; E21B 43/118; E21B 43/119; E21B 43/1185
See application file for complete search history.

(56) References Cited

U.S. PATENT DOCUMENTS 2,409,811 A 10/1946 Taylor et al.
2,595,615 A * 5/1952 Sweetman ..... F42D 1/045 102/200

(Continued)

FOREIGN PATENT DOCUMENTS

CA 2997084 A1 8/2019
CA 3065272 A1 6/2020

(Continued)

OTHER PUBLICATIONS

Albert et al., New Perforating Switch Technology Advances Safety and Reliability for Horizontal Completions, SPE/AAPG/SEG Unconventional Resources Technology Conference, San Antonio, Texas, Jul. 20-22, 2015, pp. 7.

(Continued)

*Primary Examiner* — David Carroll
(74) *Attorney, Agent, or Firm* — JL Salazar

(57) ABSTRACT

A loaded perforating gun and/or downhole perforating tool are assembled and used for perforating a wellbore. The loaded perforating gun includes a gun housing, a detonator assembly, and a plunging charge assembly. The plunging charge assembly includes a charge tube, a shaped charge, and a plunger. The plunger includes a receiving cap, and a detonator cord supported in the receiving cap. The shaped charge is operatively connected to the detonator cord. The detonator is selectively connected to the detonator cord by the plunger. The plunging charge assembly is movable between a disarmed position with the detonator cord disconnected from the detonator assembly and an armed position with the detonator cord operatively connected to the detonator assembly whereby, when the detonator can selectively pass a detonation signal via the detonator cord to the shaped charges.

23 Claims, 10 Drawing Sheets

Related U.S. Application Data application No. 16/676,246, filed on Nov. 6, 2019, now Pat. No. 11,078,763, which is a continuation-in-part of application No. 16/537,347, filed on Aug. 9, 2019, now Pat. No. 10,858,919.

(60) Provisional application No. 63/141,975, filed on Jan. 26, 2021, provisional application No. 62/717,320, filed on Aug. 10, 2018.

(56) References Cited

U.S. PATENT DOCUMENTS 2,705,159 A 3/1955 Pfau
2,883,932 A * 4/1959 Caldwell ..... E21B 43/118 175/4.53
3,024,843 A 3/1962 Dean
3,062,292 A 11/1962 Lowrey et al.
3,067,679 A * 12/1962 Caldwell ..... E21B 43/118 175/4.53
3,107,611 A * 10/1963 Caldwell ..... E21B 43/118 175/4.53
3,211,222 A 10/1965 Myers
3,246,707 A 4/1966 Bell
3,713,393 A 1/1973 O'Connor et al.
3,966,236 A 6/1976 Vann
4,011,815 A * 3/1977 Garcia ..... E21B 43/117 175/4.51
4,457,383 A 7/1984 Boop
4,497,224 A 2/1985 Jurgens
4,598,775 A 7/1986 Vann et al.
4,688,640 A 8/1987 Pritchard, Jr.
4,842,093 A 6/1989 Lerche et al.
4,886,126 A 12/1989 Yates, Jr.
5,027,708 A * 7/1991 Gonzalez ..... E21B 43/1185 102/202.1
5,042,594 A 8/1991 Gonzalez et al.
5,088,413 A 2/1992 Huber et al.
5,242,201 A 9/1993 Beeman
5,347,929 A 9/1994 Lerche et al.
5,505,134 A 4/1996 Brooks et al.
5,756,926 A 5/1998 Bonbrake et al.
5,971,072 A 10/1999 Huber et al.
5,984,006 A 11/1999 Read et al.
6,095,583 A 8/2000 Beeman et al.
6,148,263 A 11/2000 Brooks et al.
6,283,227 B1 9/2001 Lerche et al.
6,383,108 B1 5/2002 Yoo
6,386,108 B1 5/2002 Brooks et al.
6,431,269 B1 8/2002 Post et al.
6,450,541 B1 9/2002 Bakke
6,520,089 B1 2/2003 Avanci et al.
6,598,682 B2 7/2003 Johnson et al.
6,604,584 B2 8/2003 Lerche et al.
6,752,083 B1 6/2004 Lerche et al.
6,896,059 B2 5/2005 Brooks et al.
6,938,689 B2 9/2005 Farrant et al.
7,007,756 B2 3/2006 Lerche et al.
7,116,542 B2 10/2006 Lerche et al.
7,198,101 B2 4/2007 McGarian et al.
7,336,474 B2 2/2008 Lerche et al.
7,347,278 B2 3/2008 Lerche et al.
7,381,957 B2 6/2008 Medley et al.
7,383,882 B2 6/2008 Lerche et al.
7,409,987 B2 8/2008 Fjelde
7,461,580 B2 12/2008 Bell et al.
7,485,851 B2 2/2009 Medley et al.
7,485,865 B2 2/2009 Medley et al.
7,505,244 B2 3/2009 Lerche et al.
7,520,323 B2 4/2009 Lerche et al.
7,549,373 B2 6/2009 Brooks et al.
7,690,429 B2 4/2010 Creel et al.
7,762,351 B2 7/2010 Vidal
8,056,632 B2 11/2011 Goodman
8,091,477 B2 1/2012 Brooks et al.
8,230,788 B2 7/2012 Brooks et al.
8,267,012 B2 9/2012 Peeters et al.
8,576,090 B2 11/2013 Lerche et al.
8,689,868 B2 4/2014 Lerche et al.
8,884,778 B2 11/2014 Lerche et al.
8,960,093 B2 2/2015 Preiss et al.
9,140,088 B2 9/2015 Brooks
9,371,709 B2 6/2016 Brooks
9,382,783 B2 7/2016 Langford et al.
9,394,767 B2 7/2016 Brooks et al.
9,459,080 B2 10/2016 Collins et al.
9,494,021 B2 11/2016 Parks et al.
9,581,422 B2 2/2017 Preiss et al.
9,605,937 B2 3/2017 Eitschberger et al.
9,677,373 B2 6/2017 Harris
9,702,680 B2 7/2017 Parks et al.
9,719,339 B2 8/2017 Richard et al.
9,784,549 B2 10/2017 Eitschberger
9,810,035 B1 11/2017 Carr et al.
9,822,596 B2 11/2017 Clemens et al.
9,822,618 B2 11/2017 Eitschberger
9,851,191 B2 12/2017 Lerche et al.
9,903,185 B2 2/2018 Ursi et al.
9,915,513 B1 3/2018 Zemla et al.
9,951,589 B2 4/2018 Wilson
10,036,236 B1 7/2018 Sullivan et al.
10,066,921 B2 9/2018 Eitschberger
10,188,990 B2 1/2019 Burmeister et al.
10,309,199 B2 6/2019 Eitschberger
10,309,952 B2 6/2019 Rudnik et al.
10,352,136 B2 * 7/2019 Goyeneche ..... E21B 43/117
10,352,674 B2 7/2019 Eitschberger
10,365,078 B2 7/2019 Eitschberger
10,365,079 B2 7/2019 Harrington et al.
10,429,161 B2 10/2019 Parks et al.
10,507,433 B2 12/2019 Eitschberger et al.
10,557,693 B2 2/2020 Lerche et al.
10,648,300 B2 5/2020 Collins et al.
10,689,931 B2 6/2020 Mickey et al.
10,794,122 B2 10/2020 Kitchen et al.
10,844,678 B2 11/2020 Mickey et al.
10,858,919 B2 12/2020 Anthony et al.
10,890,036 B2 1/2021 Kosel et al.
10,941,625 B2 3/2021 Mickey
11,066,886 B2 7/2021 Mickey
11,078,763 B2 8/2021 Anthony et al.
11,371,305 B2 6/2022 Mickey et al.
2003/0047358 A1 3/2003 Bonkowski
2003/0196806 A1 10/2003 Hromas et al.
2004/0134667 A1 7/2004 Brewer et al.
2004/0216866 A1 * 11/2004 Barlow ..... E21B 17/042 166/55
2006/0060355 A1 3/2006 Bell et al.
2008/0149338 A1 6/2008 Goodman et al.
2010/0286800 A1 11/2010 Lerche et al.
2011/0090091 A1 4/2011 Lerche et al.
2012/0199352 A1 8/2012 Lanclos et al.
2012/0247769 A1 * 10/2012 Schacherer ..... E21B 43/117 166/63
2012/0247771 A1 10/2012 Black et al.
2012/0298361 A1 11/2012 Sampson
2013/0008669 A1 1/2013 Deere et al.
2013/0042780 A1 2/2013 Brooks et al.
2013/0153205 A1 6/2013 Borgfeld et al.
2013/0220613 A1 8/2013 Brooks et al.
2013/0337635 A1 12/2013 Yamawaku et al.
2014/0033939 A1 2/2014 Priess et al.
2014/0151018 A1 6/2014 Lerche et al.
2015/0292306 A1 10/2015 Collins et al.
2015/0292849 A1 10/2015 Lerche et al.
2015/0308795 A1 10/2015 Collins et al.
2015/0322742 A1 11/2015 Brooks
2015/0330192 A1 11/2015 Rogman et al.
2015/0337635 A1 * 11/2015 Langford ..... E21B 43/119 24/455
2015/0345916 A1 12/2015 Sokolove et al.
2015/0345922 A1 12/2015 Lanclos et al.
2016/0061572 A1 3/2016 Eitschberger et al.
2016/0115753 A1 4/2016 Frazier et al.

(56) References Cited

U.S. PATENT DOCUMENTS

| | | | |
|---|---|---|---|
| 2016/0138394 | A1 | 5/2016 | Brooks et al. |
| 2016/0168961 | A1 | 6/2016 | Parks et al. |
| 2016/0281477 | A1 | 9/2016 | Langford et al. |
| 2016/0356132 | A1 | 12/2016 | Burmeister et al. |
| 2017/0030693 | A1 | 2/2017 | Preiss et al. |
| 2017/0074078 | A1 | 3/2017 | Eitschberger |
| 2017/0119016 | A1 | 5/2017 | Cook et al. |
| 2017/0121236 | A1 | 5/2017 | Bradley et al. |
| 2017/0122083 | A1 | 5/2017 | Wilson |
| 2017/0122086 | A1 | 5/2017 | Sheng |
| 2017/0191328 | A1 | 7/2017 | Sokolove et al. |
| 2017/0198559 | A1 | 7/2017 | Golian et al. |
| 2017/0199015 | A1 | 7/2017 | Collins et al. |
| 2017/0199016 | A1 | 7/2017 | Collins et al. |
| 2017/0211363 | A1 | 7/2017 | Bradley et al. |
| 2017/0275976 | A1 | 9/2017 | Collins et al. |
| 2017/0314373 | A9 | 11/2017 | Bradley et al. |
| 2017/0370194 | A1 | 12/2017 | Lopez et al. |
| 2018/0038208 | A1 | 2/2018 | Eitschberger |
| 2018/0080298 | A1 | 3/2018 | Covalt et al. |
| 2018/0087330 | A1 | 3/2018 | Bradley et al. |
| 2018/0094910 | A1 | 4/2018 | Ashton et al. |
| 2018/0106121 | A1 | 4/2018 | Griffin et al. |
| 2018/0112500 | A1 | 4/2018 | Collins et al. |
| 2018/0216445 | A1 | 8/2018 | Collins et al. |
| 2018/0224260 | A1 | 8/2018 | Zemla et al. |
| 2018/0256724 | A1 | 9/2018 | Knipe et al. |
| 2018/0299239 | A1 | 10/2018 | Eitschberger et al. |
| 2018/0318770 | A1 | 11/2018 | Eitschberger et al. |
| 2018/0347324 | A1* | 12/2018 | Langford ..... E21B 17/028 |
| 2018/0347325 | A1* | 12/2018 | Goyeneche ..... E21B 43/11855 |
| 2019/0048693 | A1 | 2/2019 | Henke et al. |
| 2019/0085685 | A1 | 3/2019 | McBride |
| 2019/0086189 | A1 | 3/2019 | Fitschberger et al. |
| 2019/0106969 | A1 | 4/2019 | Sullivan et al. |
| 2019/0127290 | A1 | 5/2019 | Löhken et al. |
| 2019/0153827 | A1 | 5/2019 | Goyeneche |
| 2019/0162056 | A1 | 5/2019 | Sansing |
| 2019/0162057 | A1 | 5/2019 | Ashton et al. |
| 2019/0178045 | A1 | 6/2019 | Frazier et al. |
| 2019/0195054 | A1 | 6/2019 | Bradley et al. |
| 2019/0219375 | A1 | 7/2019 | Parks et al. |
| 2019/0234189 | A1 | 8/2019 | Preiss |
| 2019/0242209 | A1 | 8/2019 | Anthony et al. |
| 2019/0242222 | A1 | 8/2019 | Eitschberger |
| 2019/0257158 | A1 | 8/2019 | Langford et al. |
| 2019/0309609 | A1 | 10/2019 | Hardesty et al. |
| 2019/0330947 | A1 | 10/2019 | Mulhern et al. |
| 2019/0368293 | A1 | 12/2019 | Covalt et al. |
| 2019/0376775 | A1 | 12/2019 | Preiss et al. |
| 2020/0024935 | A1 | 1/2020 | Eitschberger et al. |
| 2020/0032626 | A1 | 1/2020 | Parks et al. |
| 2020/0072029 | A1 | 3/2020 | Anthony et al. |
| 2020/0182025 | A1 | 6/2020 | Brady |
| 2020/0190927 | A1 | 6/2020 | Mickey et al. |
| 2020/0190928 | A1 | 6/2020 | King et al. |
| 2020/0199983 | A1 | 6/2020 | Preiss et al. |
| 2020/0200516 | A1 | 6/2020 | Zemla et al. |
| 2020/0256168 | A1 | 8/2020 | Knight et al. |
| 2021/0332678 | A1 | 10/2021 | Anthony et al. |

FOREIGN PATENT DOCUMENTS

| | | | |
|---|---|---|---|
| CN | 203742568 | | 4/2014 |
| CN | 203742568 | U | 7/2014 |
| CN | 111322024 | A | 6/2020 |
| DE | 102006039096 | | 1/2008 |
| DE | 102006039096 | B3 | 1/2008 |
| EP | 601880 | A2 | 6/1994 |
| GB | 2367574 | B | 2/2003 |
| GB | 2405423 | A | 3/2005 |
| GB | 2395969 | B | 11/2005 |
| GB | 2411222 | B | 11/2006 |
| WO | 7900704 | A1 | 9/1979 |
| WO | 1979000704 | A1 | 9/1979 |
| WO | 2001016456 | A1 | 3/2001 |
| WO | 2014055061 | A1 | 4/2014 |
| WO | 2015179787 | A1 | 11/2015 |
| WO | 2016186611 | A1 | 11/2016 |
| WO | 2018112153 | A1 | 6/2018 |

OTHER PUBLICATIONS

Dynaenergetics, DynaStage Perforating Gun System—Improve Wellsite Efficiency with a Truly Modular Design, downloaded from the world wide web, dated at least as early as Aug. 10, 2018, pp. 1-2.

Dynaenergetics, DynaStage Perforating Gun System, downloaded from the world wide web, dated at least as early as Aug. 10, 2018, pp. 1-2.

Dynaenergetics, Gun Assembly, downloaded from the world wide web, dated at least as early as Aug. 10, 2018, p. 1.

Hunting, 2014 Gun System and Accessories Catalog, downloaded from the world wide web, dated 2014, pp. 1-33.

Hunting, H-1 Perforating Gun System—H-1 Gun String—TCP and Gun String—Wireline, downloaded from the world wide web, dated at least as early as Aug. 10, 2018, pp. 1-2.

Hunting, H-1 Perforating Gun System—H-1 Gun String—TCP, downloaded from the world wide web, dated at least as early as Aug. 10, 2018, p. 1.

Hunting, H-1 Perforating Gun System—Titan Division Perforating Systems, downloaded from the world wide web, dated at least as early as Aug. 10, 2018, pp. 1-2.

Hunting, Marketing White Paper: H-1 Perforating Gun System, downloaded from the world wide web, dated Jan. 2017, pp. 1-5.

Schlumberger, ASFS Addressable-Switch Firing System, downloaded from the world wide web, dated at least as early as Aug. 10, 2018, p. 1.

Schlumberger, Fractal Flex, downloaded from the world wide web, dated at least as early as Aug. 10, 2018, p. 1.

Corelab, Addressable Release Tool—(ART), downloaded from the world wide web, dated at least as early as the filing date of the present application, pp. 1-2.

Guardian, Addressable Release Tool Operations and Maintenance Manual, downloaded from the world wide web, dated at least as early as Oct. 5, 2011, pp. 1-210.

PCT International Search Report and Written Opinion dated May 3, 2022, pp. 1-14.

* cited by examiner

LOADED PERFORATING GUN WITH PLUNGING CHARGE ASSEMBLY AND METHOD OF USING SAME

CROSS-REFERENCE TO RELATED APPLICATIONS

This application claims the benefit of U.S. Patent Application No. 63/141,975 filed on Jan. 26, 2021, the entire contents of which is hereby incorporated by reference herein to the extent not inconsistent with the present disclosure. This application is also a continuation in part of U.S. patent application Ser. No. 17/366,884 filed on Jul. 2, 2021, which is a is a continuation of U.S. Non-Provisional application Ser. No. 16/676,246 filed on Nov. 6, 2019, which is a continuation-in-part of U.S. Non-Provisional application Ser. No. 16/537,347 filed on Aug. 9, 2019, which claims the benefit of U.S. Provisional Application No. 62/717,320, filed on Aug. 10, 2018, the entire contents of each of which are hereby incorporated by reference herein to the extent not inconsistent with the present disclosure.

BACKGROUND

The present disclosure relates generally to oilfield technology. More specifically, the present disclosure relates to techniques for perforating downhole.

Wells are drilled into subsurface formations to reach subsurface targets, such as valuable hydrocarbons. Drilling equipment is positioned at the surface and drilling tools are advanced into the subsurface formation to form wellbores. Once drilled, casing may be inserted into the wellbore and cemented into place to complete the well. Once the well is completed, production tubing may be deployed through the casing and into the wellbore to produce fluid to the surface for capture.

Stimulation techniques have been developed to facilitate the production of fluid from the subterranean formation and into the wellbore. For example, stimulation tools may be used for injecting and/or pumping fracturing fluids into the subterranean formation to form and/or expand fractures therethrough. Examples of injection tools are provided in U.S. Pat. No. 9,719,339, the entire contents of which is hereby incorporated by reference herein to the extent not inconsistent with the present disclosure.

In some cases, perforations may be formed along the wall of the wellbore and/or casing for passing the fracturing fluids therethrough. Stimulation tools may be deployed into the wellbore to create perforations along a wall of the wellbore and into the subterranean formation. Examples of such techniques are provided in U.S. Pat. Nos. 6,752,083; 6,752,083; EP0601880; U.S. Pat. Nos. 5,347,929; 5,042,594; 5,088,413; 9,605,937; and US20170314373, the entire contents of which are hereby incorporated by reference herein to the extent not inconsistent with the present disclosure. The perforations may be created in the wall of the wellbore using shaped charges in the stimulation tool. See, for example, U.S. Pat. No. 10,858,919; US2020/0072029; U.S. Pat. Nos. 3,713,393; 5,509,356; US20120199352; US20170211363; US20170275976; US20170089678; and US20180216445, the entire contents of which are hereby incorporated by reference herein to the extent not inconsistent with the present disclosure.

Despite the advancements in downhole technology, there remains a need for techniques for safer, more efficient, more reliable, and more effective perforating. The present disclosure is directed at providing such needs.

SUMMARY

In at least one aspect, the present disclosure relates to a loaded perforating gun and/or downhole perforating tool as shown in the drawings and described herein. The loaded perforating gun is positionable in a wellbore penetrating a subterranean formation. The loaded perforating gun comprises a gun housing; a detonator assembly positioned in the gun housing, the detonator assembly comprising a detonator and a detonation switch; and a plunging charge assembly positioned in the gun housing. The plunging charge assembly comprises a charge tube, a shaped charge; and a plunger. The plunger comprises a receiving cap and a detonator cord. The receiving cap is connected to the charge tube. The detonator cord is supported in the receiving cap. The shaped charge is operatively connected to the detonator cord. The plunging charge assembly is movable between a disarmed position with the detonator cord disconnected from the detonator assembly and an armed position with the detonator cord operatively connected to the detonator assembly whereby, the detonator can selectively pass a detonation signal via the detonator cord to the plunging charge assembly to ignite the shaped charges.

The plunger further comprises a compression mechanism. The detonator assembly comprises a detonator housing, the compression mechanism compressible between the plunging charge assembly and the detonator housing. The loaded perforating gun further comprises a bulkhead assembly at one end of the gun housing and an endcap at an opposite end of the gun housing. The bulkhead assembly is connected to the detonator assembly. The endcap is connected to the plunging charge assembly. The detonation switch is communicatively connected to the detonator and a surface unit to pass activation signals therebetween. The detonator assembly further comprises a detonator housing and a detonator nose, the detonator supported in the detonator housing and the detonator nose. The detonator nose supports the detonator therein, and the detonator nose is extendable into the receiving cap and slidably movable about the receiving cap for selective engagement between the detonator and the detonator cord.

In another aspect, the disclosure relates to a downhole perforating tool positionable in a wellbore penetrating a subterranean formation. The downhole perforating tool comprising a tool housing; and the loaded perforating gun described above positionable about the tool housing.

Finally, in another aspect, the disclosure relates to a method of assembling a downhole perforating gun. The method comprises positioning a plunging charge assembly and a detonator assembly in a tool housing; connecting a detonator cord to a shaped charge in the plunging charge assembly; and selectively arming the detonator assembly by selectively moving the plunging charge assembly between a disarmed position with the detonator cord disconnected from a detonator in the detonator assembly and an armed position with the detonator cord connected to the detonator.

The method may also involve communicatively connecting a communication link from a surface unit to a switch of the detonator assembly. The selectively arming the detonator assembly comprises: selectively moving the detonator into contact with the detonator assembly by compressing the plunger against the detonator assembly, isolating the detonator from the plunging charge assembly by shifting the plunging charge assembly to the disarmed position, and/or the selectively arming the detonator assembly comprises communicatively connecting the detonator to the shaped charge by shifting the plunging charge assembly to the armed position.

Finally, in another aspect, the disclosure relates to a method of perforating a wellbore. The method comprises providing a loaded perforating gun comprising a gun housing with a plunging charge assembly and a detonator assembly therein; selectively moving the plunging charge assembly from a disarmed position to an armed position such that a detonator cord in the plunging charge assembly is connected to a shaped charge in the plunging charge assembly and to a detonator in the detonator assembly; positioning the loaded perforating gun in the wellbore with the plunging charge assembly in the armed position; and while the plunging charge assembly is in the armed position, detonating the shaped charge by sending a detonation signal from the detonator and to the shaped charge via the detonator cord.

The method further comprises selectively connecting a communication link from a surface unit to the detonator switch and from the detonator switch to the detonator. In the armed position the communication link is connected to the detonator and in the disarmed position the communication link is disconnected from the detonator. The method further comprises sending a trigger signal from the surface unit to the detonator via the communication link. The selectively moving the plunging charge assembly comprises shifting the plunging charge assembly while compressing a compression mechanism between the plunging charge assembly and the detonator assembly.

This Summary is not intended to be limiting and should be read in light of the entire disclosure including text, claims and figures herein.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. The appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

Figure 1:
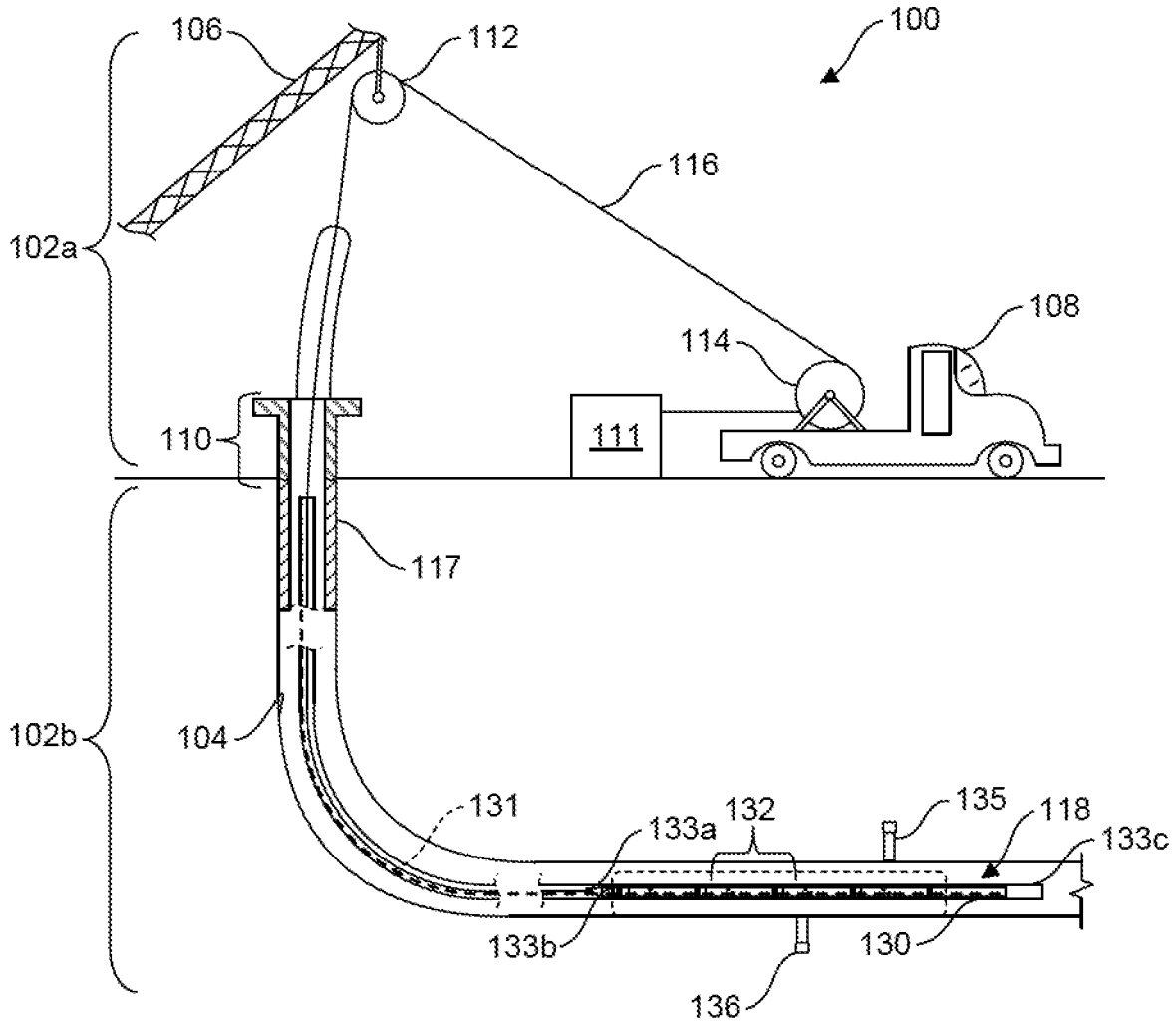
FIG. 1 is a schematic diagram depicting a wellsite with surface and downhole equipment, the downhole equipment comprising a downhole perforating tool including loaded perforating guns for perforating a wellbore.

The description that follows includes exemplary apparatus, methods, techniques, and/or instruction sequences that embody techniques of the present subject matter. However, it is understood that the described embodiments may be practiced without these specific details.

The present disclosure relates to a downhole perforating tool including a loaded perforating gun (detonation assembly) with a plunging charge assembly. The loaded perforating gun includes a gun (outer) housing, the plunging charge assembly with a shaped charge(s), and a detonator assembly with a detonator. The plunging charge assembly includes a detonation (primer) cord connected to the shaped charge and a shape charge carrier tube. The plunging charge assembly is selectively connected to the detonator assembly for selectively allowing the detonator to detonate the detonator cord, thereby detonating the shaped charge.

The plunging charge assembly may include a spring-loaded plunger (e.g., connector with a spring or similar mechanism) for selectively moving the plunging charge assembly between a disarmed (e.g., disengaged, disconnected, unarmed) position with a detonator cord disconnected from the detonator assembly and an armed (e.g., engaged, connected) position with the detonator cord connected to the detonator. The detonator is isolated from the plunging charge assembly until the plunging charge assembly is moved to the armed position. This isolation may be used to prevent activation of the detonator cord, thereby preventing detonation of the shaped charges until desired. When installed on another perforating gun, the plunging charge assembly may be moved to the armed position to allow the shaped charges to be detonated. In the armed position, the detonator cord is connected to the detonator and the detonator may be initiated to detonate the shaped charge (s).

The charge and detonator assemblies may also be provided with other features, such as quick-locking features for quick, one-way, redundant, and secure assembly and operation. For example, the charge and detonator assemblies may have one-way pin and guide (e.g., slot) locking mechanisms (with or without additional locks) for securing the components in place. In another example, the charge and detonator assemblies may have components shaped for one-way insertion into and/or connection with adjacent components to assure proper positioning and fit of the components. The charge and detonator assemblies may also have locking contacts with push-in place dual spring activation and redundant contact surfaces for maintaining a communication connection with the detonator and/or between the detonator assembly and the charge assembly for the passage of signals therebetween. The communication links and/or connections may be or include various communication components, such as wires, cables, plates, contacts, switches, plugs, and/or other features, capable of passing electrical, power, and/or other signals.

The present disclosure seeks to provide one or more of the following features including, but not limited to: compliance with safety regulations for transport and/or use of detonators (e.g., Department of Transportation (DOT) and Bureau of Alcohol Tobacco and Firearms (ATF)), transport of loaded (assembled) perforating guns, prevention of inadvertent actuation (e.g., detonation, ignition), pre-assembly of equipment at offsite locations (e.g., machine shops), assembly prior to transport, quick onsite installation and use, isolation of explosive items from detonation, selective activation of detonators when needed, providing a self-arming gun, providing a secure barrier to prevent arming until needed, providing integrated charge and detonation assemblies (and associated components) within the same structure, protection of the charge assembly from activation by the detonator until intended, spring-loaded/damped connection, activatable multiple contact switch, self-arming capabilities, arming without requiring additional insertion or wiring, assembled and ready for use, etc.

FIG. 1 is a schematic diagram depicting a wellsite 100 with surface and downhole equipment 102*a,b*. The wellsite 100 may be any wellsite positioned about a subterranean formation, such as an unconventional formation (e.g., shale) with a reservoir (e.g., oil, gas, water) therein. The wellsite 100 is provided with a wellbore 104. The surface equipment 102*a* is positioned along the surface about the wellbore 104, and the downhole equipment 102*b* extends into the wellbore 104.

The surface equipment 102*a* includes a crane 106, a truck 108, a wellhead assembly 110, and a surface unit 111. The crane 106 supports a pulley 112. The truck 108 supports a spool 114. A conveyance (e.g., wireline) 116 extends from the spool 114 over the pulley 112 and into the wellbore 104. The surface unit 111 is coupled to the conveyance 116 for communication therewith.

The downhole equipment 102*b* includes a casing 117 positioned in the wellbore 104 and the downhole perforating tool 118 is supported in the wellbore 104 by the conveyance 116. The casing 117 is a tubular member that lines the wellbore 104 and is connected to the wellhead assembly 110. Note that in some cases, the casing 117 may be omitted (e.g., for openhole applications), or the casing 117 may be installed in only a portion of the wellbore 104.

The downhole equipment 102*b* comprises a downhole perforating tool 118 including loaded perforating guns 132 for perforating a wellbore 104. The downhole perforating tool 118 may be any downhole tool that can operatively support the loaded perforating guns 132 in the wellbore 104. The downhole perforating tool 118 comprises a tool housing 130 with a series of the loaded perforating guns 132 therein. The tool housing 130 is a tubular member positionable in the wellbore 104 by the conveyance 116 and shaped to receivably support each of the loaded perforating guns 132 therein.

The downhole perforating tool 118 may include one or more of the loaded perforating guns 132. Multiple of the loaded perforating guns 132 may be connected together end to end in series. In the illustrated example, there are four loaded perforating guns 132 shown, but one or more loaded perforating gun 132 may be included. Threaded connections may be provided at each end of the loaded perforating gun 132 for connecting one or more loaded perforating gun 132 together. In some cases, the loaded perforating guns 132 may be connected to an end of the tool housing 130 (e.g., by threaded connection). The downhole perforating tool 118 may be used with one or more of the loaded perforating guns alone, or in combination with other types of perforating guns, such as those incorporated by reference herein.

The downhole perforating tool 118 may also be provided with various other components, such a conveyance connector 133*a*, a collar locator ("CCL") 133*b*, and a plug setting tool 133*c*, as shown in the example of FIG. 1. The conveyance connector 133*a* may be provided at an uphole end of the downhole perforating tool 118 for connection to the wireline 116. The CCL 133*b* may be positioned along the downhole perforating tool 118 to detect collars of the casing 117 as the downhole perforating tool 118 passes through the wellbore 104. The plug setting tool 133*c* may be positioned at a downhole end of the downhole perforating tool 118 to secure the downhole perforating tool 118 at specified depths along the wellbore 104.

The loaded perforating guns 132 each carry one or more shaped charges 136. The shaped charges 136 are explosive components that are detonated from within the perforating tool 118 to form a perforation 135 in the wall of the wellbore 104 when activated. This perforation 135 extends through the wall of the wellbore 104 (and the casing 117 and cement if present) and into the subterranean formation surrounding the wellbore 104. The shaped charges 136 may be configured to create the perforations 135 for passage of fracturing (or injection) fluid into the formation for hydraulic fracturing therein.

The loaded perforating guns 132 (and other portions of the downhole perforating tool 118) may be communicatively connected to the surface unit 111 by the wireline 116 and/or by other means (e.g., wireline, electromagnetic, sonar, or other communication means). A communication link 131, such as a feed thru wire (or other wire, cable, etc.), may extend from the wireline 116 through the tool housing 130 and/or the loaded perforating guns 132 as indicted by the dashed lined.

The loaded perforating guns 132 may be connected by the communication link 131 for communication therebetween and/or for communication with the other components of the downhole perforating tool 118. The loaded perforating guns 132 may be independently operated, or communicatively linked together via the communication link 131 for integrated operation therebetween.

The loaded perforating gun(s) 132 may be activated by the surface unit 111 (e.g., by sending a trigger signal via the communication link 131) to selectively fire one or more of the shaped charges 136 to form the perforations 135 as schematically depicted in FIG. 1. The loaded perforating gun 132 may also be maintained in a disarmed position until ready to perform a perforating operation, and then shifted to the armed position to perform the perforation operation as is described further herein.

Figure 2A:
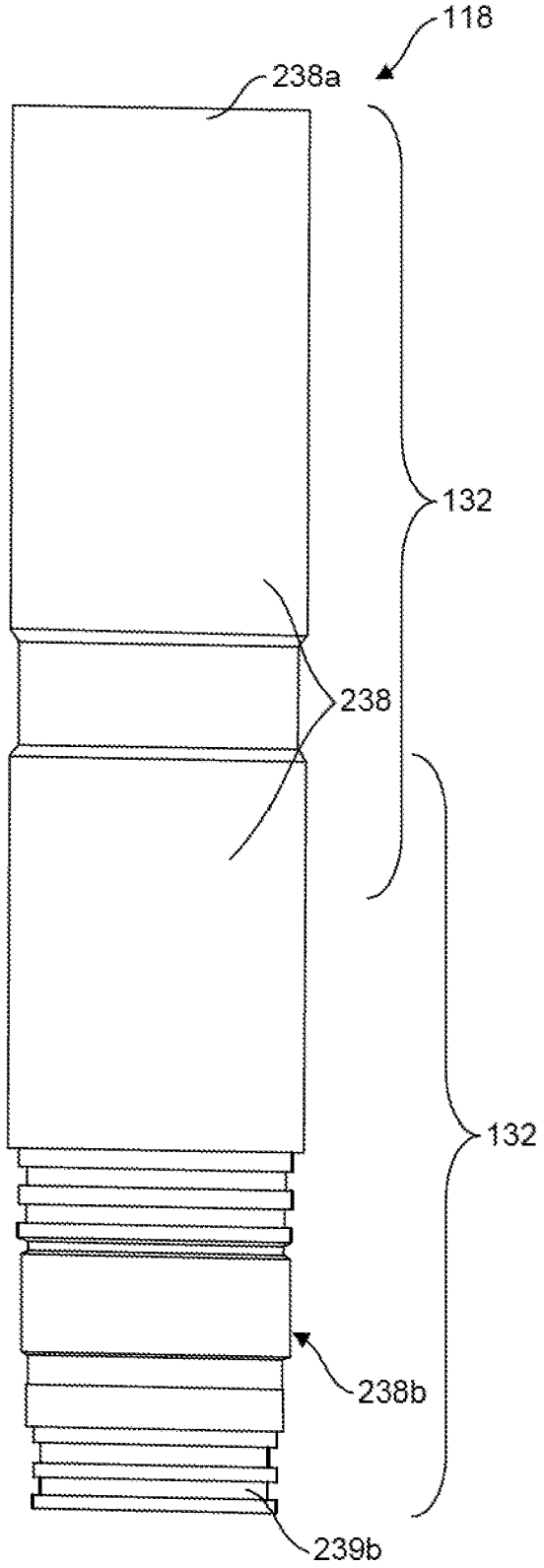
FIGS. 2A and 2B are plan and longitudinal cross-sectional views, respectively, depicting a portion of the downhole perforating tool including two of the loaded perforating guns.
Figure 2B:
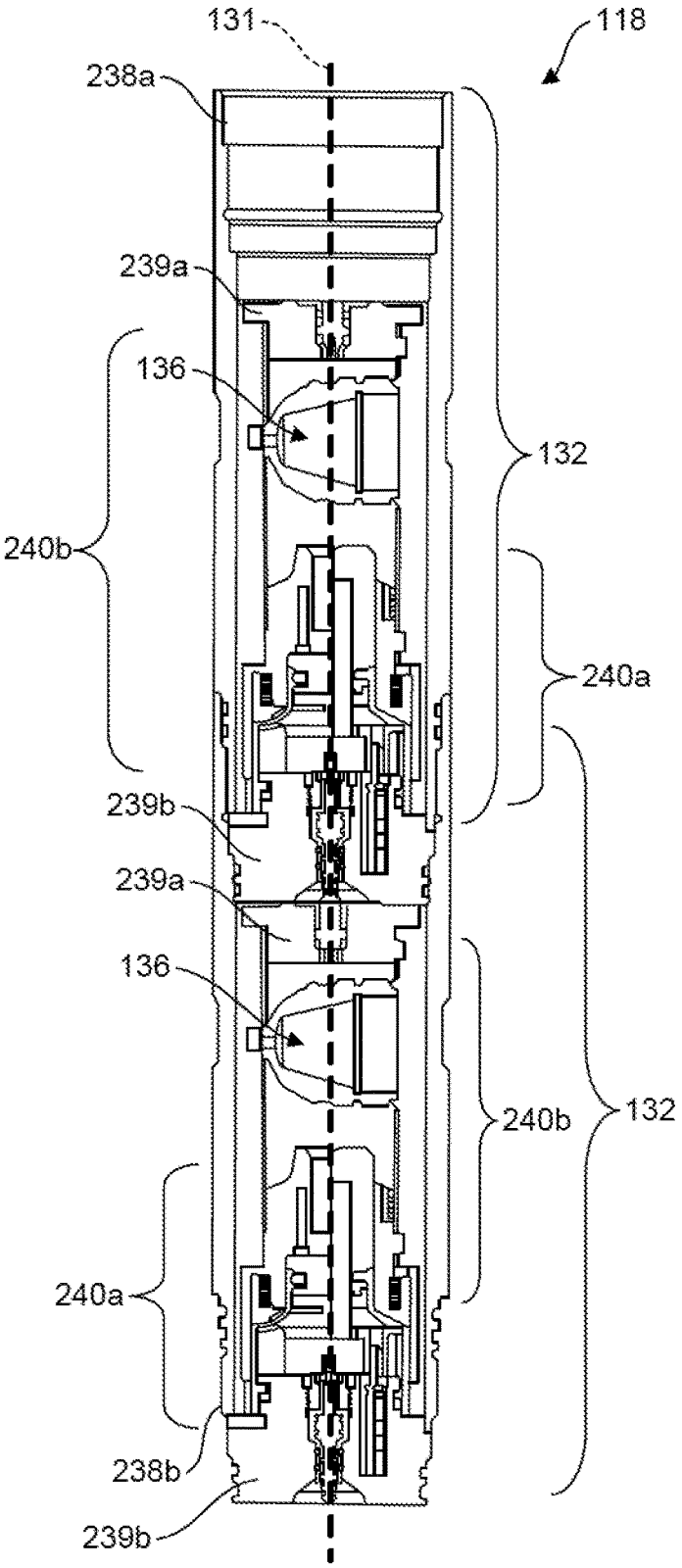

FIGS. 2A and 2B are plan and longitudinal cross-sectional views, respectively, depicting a portion of the downhole perforating tool 118 including two of the loaded perforating guns 132. As shown in these views, the loaded perforating guns 132 each include a gun housing 238, a detonator assembly 240*a*, and a plunging charge assembly 240*b*.

The gun housing 238 is a tubular member positionable in or connectable (e.g., by threaded connection) to the tool housing 130 of the downhole perforating tool 118 (FIG. 1). The gun housing 238 is also shaped for connection to the gun housing 238 of an adjacent loaded perforating gun 132. The gun housing 238 has a tubular body with a threaded box 238*a* at one end and a threaded pin 238*b* at another end.

The loaded perforating guns 132 are also provided with an endcap assembly 239*a* at one end of the gun housing 238 and a bulkhead assembly 239*b* at an opposite end of the gun housing 238. The endcap assembly 239*a* is positioned about the box 238*a* adjacent the plunging charge assembly 240*b*. The endcap assembly 239*a* is connectable to the plunging charge assembly 240*b*, and to a bulkhead assembly 239*b* of an adjacent loaded perforating gun 132 for operation therewith.

The bulkhead assembly 239*b* is positioned about the threaded pin 238*b* adjacent the detonator assembly 240*a*. The bulkhead assembly 239*b* is connectable to the detonator assembly 240*a* and to the box 238*a* of an adjacent loaded perforating gun 132. An inner portion of the bulkhead assembly 239*b* may extend into the gun housing 238 for connection to the detonator assembly 240*a*. An outer portion of the bulkhead assembly 239*b* may extend from the pin 238*b* for connection to the endcap assembly 239*a* of the adjacent loaded perforating gun 132.

The detonator assembly 240*a* is positioned in the gun housing 238 and is connected to the bulkhead assembly 239*b* for detonating the shaped charges 136 as described further herein. The plunging charge assembly 240*b* is positioned in the gun housing 238 between the detonator assembly 240*a* and the endcap assembly 239*a*. The plunging charge assembly 240*b* is connected to the detonator assembly 240*a* for selective activation thereof. The plunging charge assembly 240*b* is selectively movable about the detonator assembly 240*a* for selectively allowing signals to pass therebetween as is described further herein.

The communication link 131 extends through the loaded perforating guns 132 as schematically shown. The endcap assembly 239*a* and the bulkhead assembly 239*b* of each of the loaded perforating guns 132 may be coupled to the detonator assembly 240*a* and the plunging charge assembly 240*b* by the communication link 131 for selective operative communication therebetween as described further herein.

Figure 3:
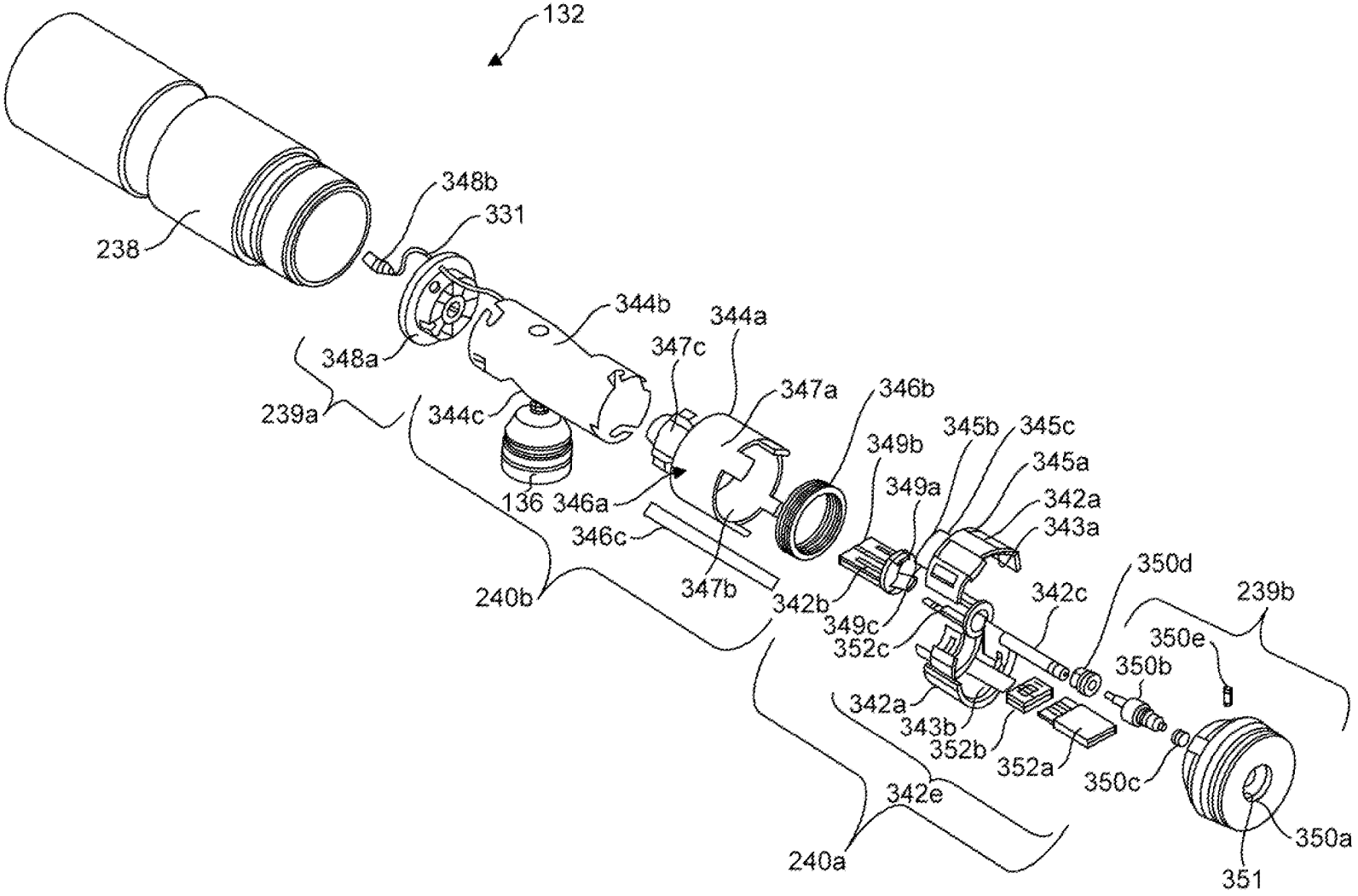
FIG. 3 is an exploded view of the loaded perforating gun.
Figure 4A:
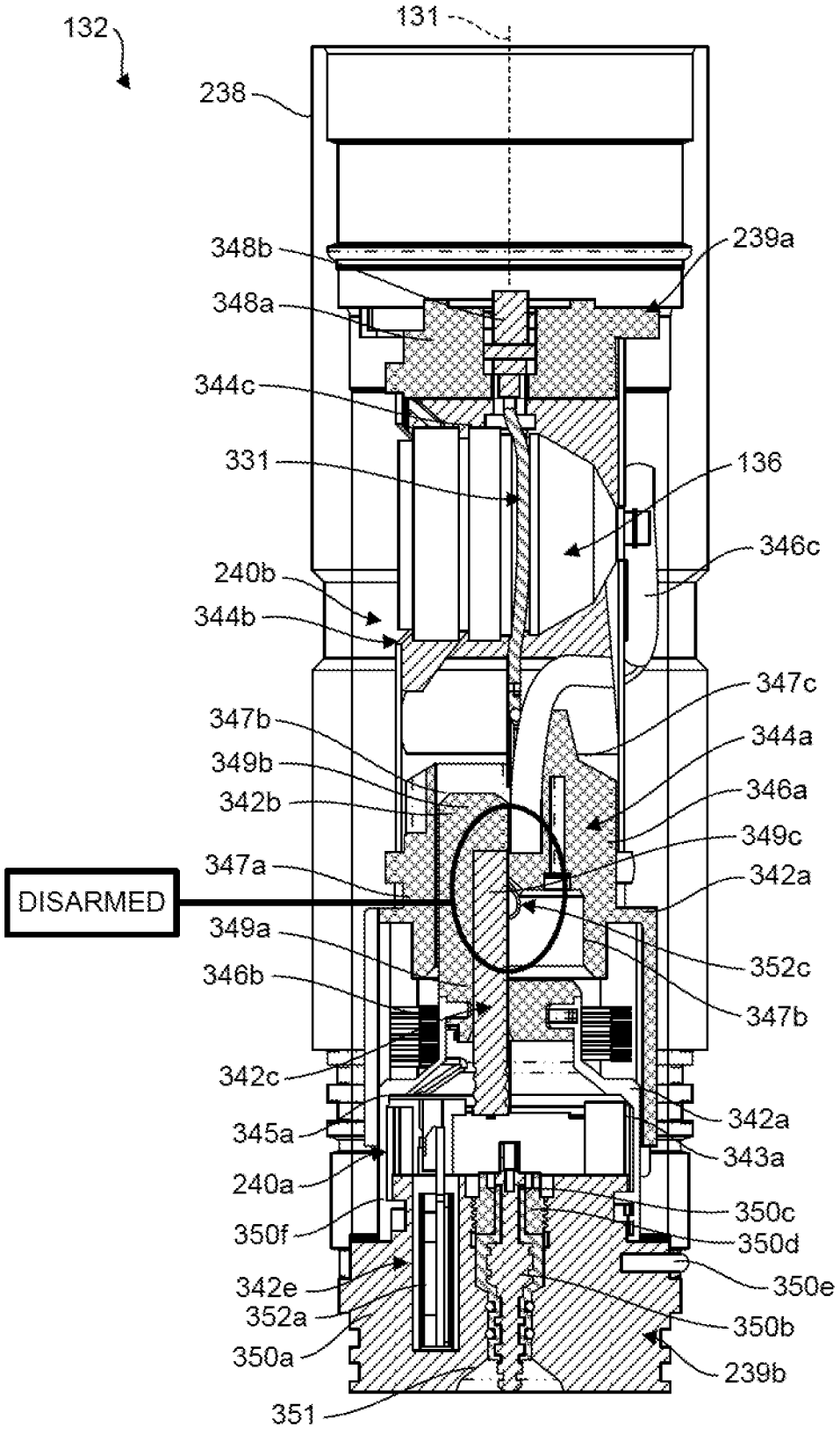
FIGS. 4A and 4B are partial cross-sectional views of the loaded perforating gun in a disarmed and an armed position, respectively.
Figure 4B:
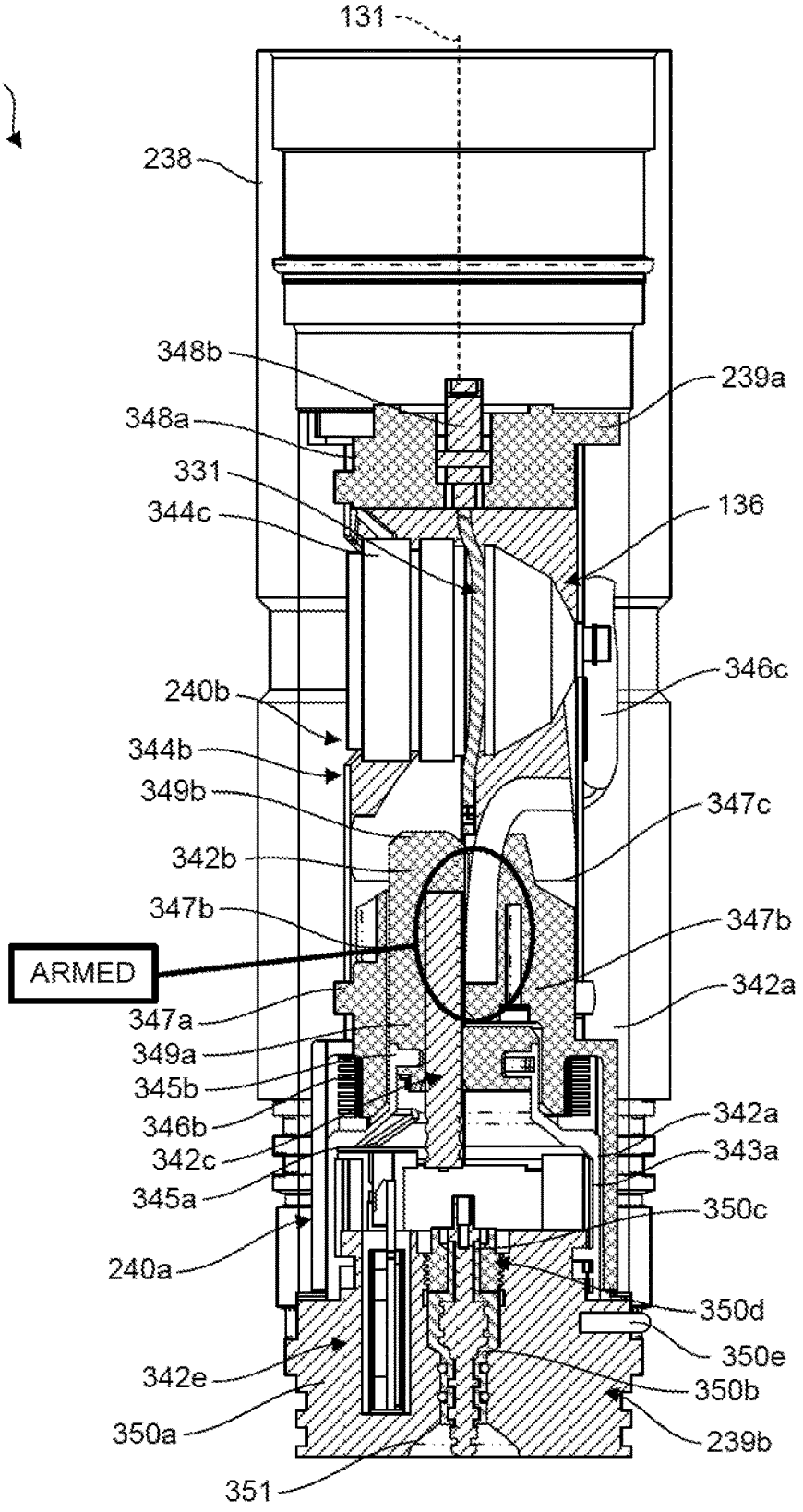
Figure 5A:
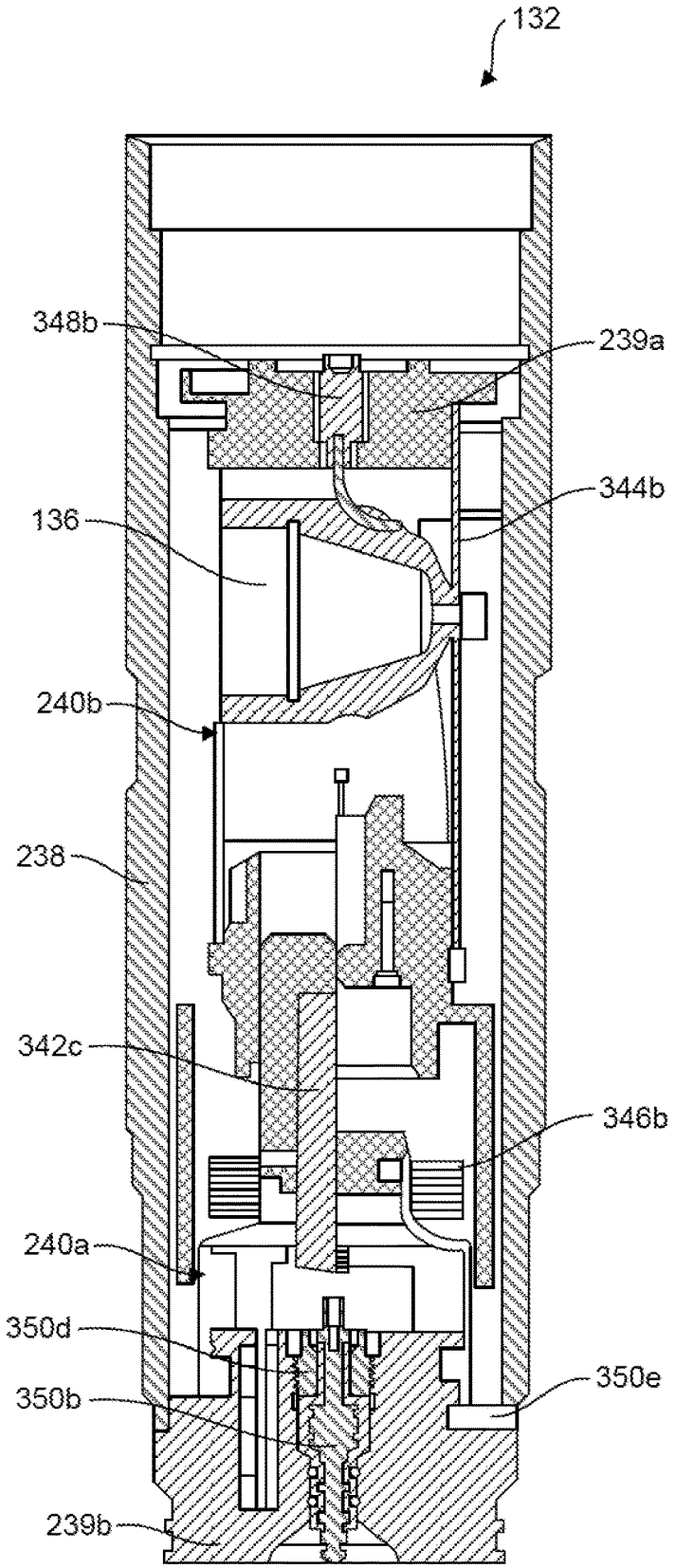
FIGS. 5A and 5B are additional partial cross-sectional views of the loaded perforating gun in a disarmed and an armed position, respectively.
Figure 5B:
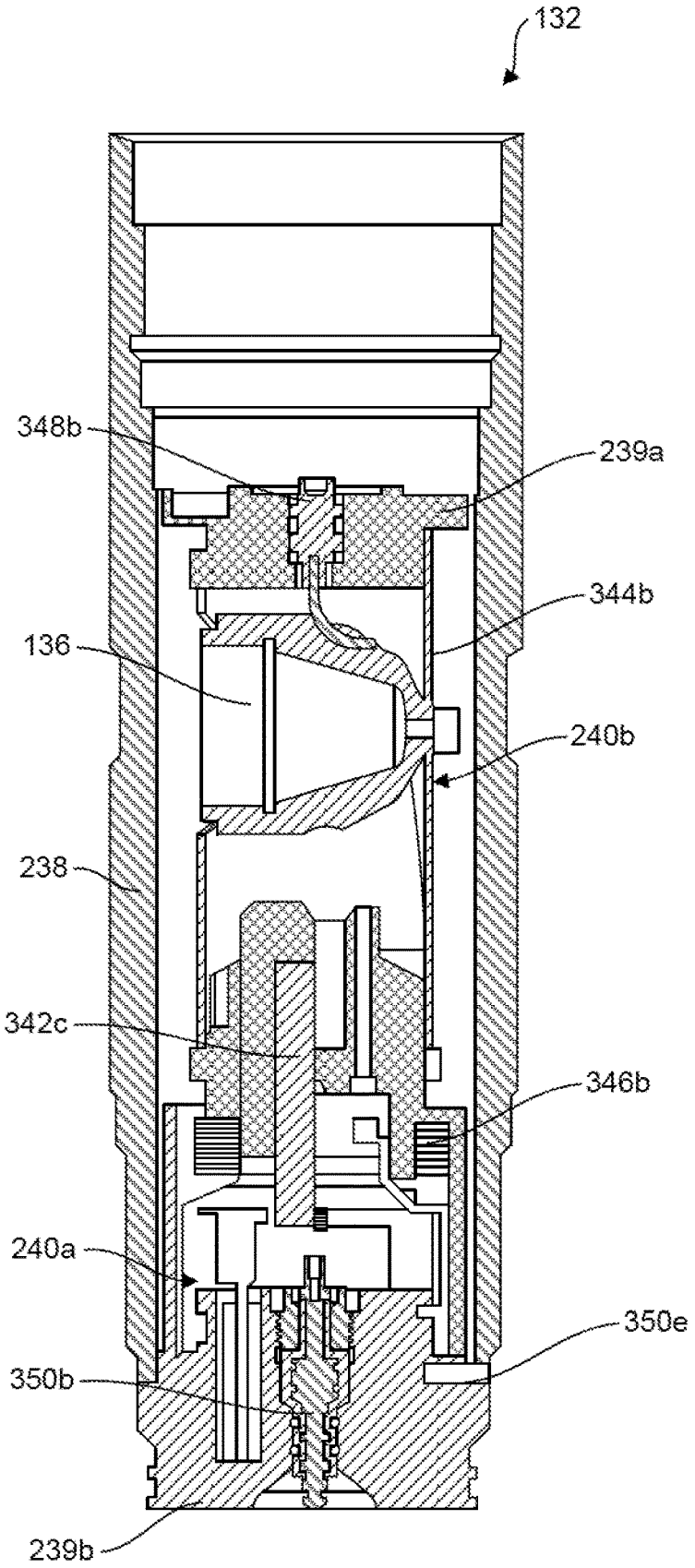

FIGS. 3, 4A—4B, and 5A-5B show additional views of the loaded perforating gun 132. FIG. 3 is an exploded view of the loaded perforating gun 132. FIGS. 4A and 4B are partial cross-sectional views of the loaded perforating gun 132 in a disarmed and an armed position, respectively. FIGS. 5A and 5B are additional partial cross-sectional views of the loaded perforating gun 132 in the disarmed and armed position, respectively. These figures show additional views of the gun housing 238, the bulkhead assembly 239*b*, the detonator assembly 240*a*, the plunging charge assembly 240*b*, and the endcap assembly 239*a* in greater detail.

The bulkhead assembly 239*b* is positionable at an end of the gun housing 238 and is connectable to the detonator assembly 240*a*. The bulkhead assembly 239*b* includes a bulkhead 350*a*, a bulkhead feedthru 350*b*, bulkhead o-ring 350*c*, an insulated feed thru retainer 350*d*, and a detent 350*e*. The bulkhead 350*a* is a cylindrically shaped member positionable in and matable with the gun housing 238 via the detent 350*e*.

The bulkhead 350*a* has a hole 351 therethrough shaped to support the bulkhead feedthru 350*b* therein. The bulkhead o-rings 350*c* are positioned between the bulkhead feedthru 350*b* and the bulkhead 350*a* for providing fluid and pressure isolation therebetween. The insulated feed thru retainer 350*d* may be a nut positioned in the bulkhead 350*a* threadedly connectable between the bulkhead 350*a* and the insulated bulkhead feedthru 350*b*. The detent 350*e* may be a pin extendable into an outer surface of the bulkhead 350*a* and an inner surface of the gun housing 238 to prevent rotation therebetween.

The detonator assembly 240*a* is connectable to the bulkhead assembly 239*b*. The detonator assembly 240*a* includes a detonator housing 342*a*, a detonator nose 342*b*, the detonator 342*c*, and a switch assembly 342*e*. The detonator housing 342*a* may be a hollow member including one or more portions (two hemispherical portions are shown) connectable together to define a switch chamber 343*a* for receiving the detonator 342*c* and the switch assembly 342*e* therein. The detonator housing 342*a* is connectable to the bulkhead 350*a* by locking tabs 343*b*. The locking tabs 343*b* extend from the detonator housing 342*a* and are lockingly receivable in a slot about the outer periphery of the bulkhead 350*a*.

The detonator housing 342*a* has a bulkhead portion 345*a* connectable to the bulkhead assembly 239*b* at one end and a nose portion 345*b* connectable to the detonator nose 342*b* at an opposite end thereof. The bulkhead portion 345*a* has a larger dimension (e.g., larger diameter) that tapers down to the nose portion 345*b*, which has a smaller dimension (e.g., smaller diameter than the larger diameter). A step 345*c* is defined along the outer surface of detonator housing 342*a* between the bulkhead portion 345*a* and the nose portion 345*b*.

The detonator nose 342*b* may include a detonator portion 349*a* connectable to the detonator housing 342*a* and an elongate plunger portion 349*b* insertable into the plunging charge assembly 240*b*. The detonator nose 342*b* has a detonator chamber 349*c* for receiving the detonator 342*c* therein. The detonator nose 342*b* is connectable to the switch assembly 342*e*, the detonator 342*c*, and to the plunging charge assembly 240*b* for operation therewith as is described further herein.

The detonator 342*c* is an elongate member positionable in the detonator housing 342*a* and the detonator nose 342*b*. The detonator 342*c* may be an explosive device used to initiate the shaped charges 136 as described further herein. Examples of detonators are described in one or more of the patents/applications previously incorporated by reference herein.

The switch assembly 342*e* may be an electrical device for selectively activating the detonator 342*c*. The switch assembly 342*e* includes a switch 352*a*, a switch connector 352*b*, and electrical contacts 352*c*. The switch assembly 342*e* may be seated in the bulkhead 350*a* and extend into the detonator housing 342*a* for selectively activating the detonator 342*c*. The switch assembly 342*e* may be connected to the communication link 131 for receiving a trigger signal from the surface unit 111, and for selectively sending a signal to the detonator 342*c* as is described further herein.

The switch 352*a* may be positioned in the bulkhead 350*a*. The switch 352*a* may be an electrical switch, such as an addressable switch, connectable to the communication link 131. The switch 352*a* may be electrically connected to the bulkhead feedthru 350*b* and to the electrical contacts 352*c*. The switch connector 352*b* may electrically connect the switch 352*a* to the electrical contacts 352*c*. The electrical contacts 352*c* may extend into the plunger portion 349*b* of the detonation nose 342*b* for electrical connection to the plunging charge assembly 240*b* as is described further herein. Upon receipt of a signal (e.g., trigger signal from the surface unit 111 of FIG. 1), the switch 352*a* may be activatable to selectively send a detonation (initiation) signal to the detonator 352*c* as is described further herein.

The plunging charge assembly 240*b* is connected to the detonator assembly 240*a*. The plunging charge assembly 240*b* includes a plunger 344*a*, a charge tube 344*b*, and the shaped charge 136. While one shaped charge 136 is shown, one or more shaped charges may be included.

The plunger 344*a* is connected to the detonator assembly 240*a* and the charge tube 344*b*. The plunger 344*a* includes a receiving cap 346*a*, a compression mechanism (e.g., spring) 346*b*, and a detonator cord 346*c*. The receiving cap 346*a* is a has a cylindrical body including a detonator portion 347*a* with a nose chamber 347*b* therein and a tube cap 347*c* extending therefrom. The tube cap 347*c* extends from the detonator portion 347*a*, and is shaped for insertion into the charge tube 344*b*. The tube cap 347*c* may be secured to the charge tube 344*b* for movement therewith.

The nose chamber 347*b* may be shaped to slidingly receive the plunger portion 349*b* of the detonator nose 342*b* of the detonator assembly 240*a*. The detonator cord 346*c* may be supported in and extend through the receiving cap 346*a* adjacent to the plunger portion 349*b* of the detonator nose 342*b*. The detonator cord 346*c* may be connected to the shaped charges 136 at one end. At another end, the detonator cord 346*c* may be positionable by movement of the plunging charge assembly 240*b* (e.g., movement of the receiving cap 346*a* and the compression mechanism 346*b* of the plunging charge assembly 240*b*) into connection with the detonator 342*c* of the detonator assembly 240*a* as is described further herein.

The compression mechanism 346*b* may be any mechanism, such as a spring, capable of dampening movement between the plunging charge assembly 240*b* and the detonator assembly 240*a*. The compression mechanism 346*b* may be, for example, a stacked wave disc spring positioned between the receiving cap 346*a* and the detonator housing 342*a* to selectively break communication between the detonator 342*c* and the detonator cord 346*c*. The compression mechanism 346*b* may be seated about the step 345*c* of the detonator housing 342*a* and compressed by movement of the receiving cap 346*a* of the plunging charge assembly 240*b* towards the detonator housing 342*a*. The compression mechanism 346*b* may also be used to selectively arm the loaded perforating gun 132 when a spring force of the compression mechanism 346*b* is overcome, and to retract the loaded perforating gun 132 to its disarmed position when detonation is complete as described further herein.

The charge tube 344*b* is a tubular member shaped to receive the tube cap 347*c* of the plunger 344*a* therein. The charge tube 344*b* may be secured at one end to the tube cap 347*c* by, for example, connectors (e.g., screws or tabs). The charge tube 344*b* may have slots (or holes) for receiving the connectors. The charge tube 344*b* is connected at an opposite end to the endcap assembly 239*a*. The charge tube 344*b* may have charge openings 344*c* for receiving the shaped charges 136 therein.

The shaped charges 136 may be supported about the openings 344*c* by clips (not shown). The detonator cord 346*c* extends from the plunger 344*a*, around the charge tube 344*b* and to the shaped charge 136. The shaped charges 136 may be explosive components detonated by a detonation signal from the detonator 342*c*. The detonator cord 346*c* may be used to pass the detonation signal from the detonator 342*c* to the shaped charge 136 when the plunging charge assembly 240*b* is in the armed position as is described further herein.

The endcap assembly 239*a* is connectable to the charge tube 344*b*. The endcap assembly 239*a* includes an endcap 348*a* and a feedthru plunger 348*b*. The endcap 348*a* may be a circular member seatable within the gun housing 238 and extending into the charge tube 344*b* to enclose the end thereof. The feedthru plunger 348*b* is positioned in the endcap assembly 239*a*. The endcap assembly 239*a* and the feedthru plunger 348*b* may be connected to the bulkhead feedthru 350*b* and the bulkhead 350*a*, respectively, of an adjacent loaded perforating gun 132.

The feedthru plunger 348*b* is an electrical connector connectable to the communication link 131 (FIGS. 1 and 2B). If an adjacent loaded perforating gun 132 is present, the feedthru plunger 348*b* may be electrically connected to the bulkhead feedthru 350*b* of the adjacent loaded perforating gun 132 for electrical communication therewith.

As shown in FIGS. 3 and 4A-4B, a portion of the communication link 131 (FIGS. 1 and 2B) may include an electrical wire 331 extending from the endcap assembly 239*a* and to the plunging charge assembly 240*b*. The electrical wire 331 may extend through the loaded perforating gun 132 and form part of the communication link 131 for passing signals through the loaded perforating gun(s) 132. The electrical wire 331 extends from the feedthru plunger 348*b*, through the charge tube 344*b*, and into the receiving cap 346*a* of the plunging charge assembly 240*b*.

The electrical wire 331 extends through the plunger 344*a* for connection to the switch assembly 342*e* of the detonator assembly 240*a* and for electrical communication therewith. The plunger 344*a* may electrically connect the electrical wire 331 to the electrical contacts 352*c* when in the armed position, and electrically disconnected from the electrical contacts 352*c* when in the disarmed position as is described further herein.

An electrical signal may be passed from the surface unit 111 to the downhole perforating tool 118 via the conveyance 116 as shown in FIG. 1. The electrical signal may pass from the conveyance 116 and through the downhole perforating tool 118 via the communication link 131 as also shown in FIG. 1. The electrical signal may then pass through the loaded perforating guns 132 via the electrical wire 331 as shown in FIGS. 4A-4B.

The electrical signal passes via the electrical wire 331 from the feedthru plunger 348*b*, through the plunging charge tube 344*b* and to the plunger 344*a*. When in the armed position, the electrical signal is passed from the plunger 344*a* and to the switch assembly 342*e* via the electrical contacts 352*c*.

The switch assembly 342*e* is also connected by the switch 352*a* to the detonator 342*c* for passing the electrical signal thereto. The switch assembly 342*e* may be triggered by the electrical signal (sent form the surface unit) through the switch 352*a*, thereby activating the detonator 342*c*. Once activated, the detonator 342*c* passes the detonation signal via the detonator cord 346*c* to the shaped charge(s) 136. Upon receipt of the detonation signal, the shaped charge 136 is detonated and explodes. This explosion emits gasses under sufficient pressure to pierce the casing 117 and the surrounding formation to form the perforation 135 (see, e.g., FIG. 1).

As shown in FIGS. 4A-4B and 5A-5B, the plunger 344*a* may be used to selectively position the loaded perforating gun 132 in a disarmed or an armed position. In some cases, such as during transport or when not in use, the loaded perforating gun 132 may be placed in the disarmed position to prevent inadvertent actuation of the shaped charges 136, or to meet client requirements and/or safety regulations. In one example, to prevent such inadvertent actuation, the loaded perforating gun 132 may be left unassembled or disassembled to prevent actuation of the shaped charges 136.

In another example, the loaded perforating gun 132 may be fully loaded (e.g., fully assembled and ready for use) as shown in FIGS. 4A and 4B. Once loaded, the loaded perforating gun 132 may be shifted by the plunging charge assembly 240*b* to a disarmed position which prevents actuation. In the disarmed (disengaged) position as shown in FIGS. 4A and 5A, the electrical signal is prevented from passing from the plunging charge assembly 240*b* and to the detonator assembly 240*a*, and the detonation signal is prevented from passing from the detonator assembly 240*a*, through the detonator cord 346*c*, and to the shaped charges 136. The plunger 344*a* is positioned with the electrical wire 331 in the plunging charge assembly 240*b* a distance from the electrical contacts 352*c*, thereby preventing communication of the activation signal from the surface unit 111 to the switch assembly 342*e* and the detonator 342*c*.

In the disarmed position, the plunger 344*a* is also positioned with the detonator cord 346*c* a distance from the detonator 342*c*, thereby preventing communication of the detonation signal from the detonator 342*c* to the shaped charge 136. The plunger 344*a* effectively disconnects the detonator 342*c* from receiving activation signals and from sending detonation signals. When the plunging charge assembly 240*b* is disarmed, the plunger 344*a* with the detonator cord 346*c* is positioned a distance axially away from the detonator 342*c*. The detonator cord 346*c* is disengaged from the detonator 342*c*, thereby shielding the detonator cord 346*c* and the shaped charge 136 from an accidental detonation. Because the electrical connection is also broken between the electrical wire 331 and the detonator 342*c*, the possibility of accidental detonation via electrical current is further eliminated.

When the downhole perforating tool 118 is in a desired position in the wellbore 104 and a perforation 135 is intended to be made (FIG. 1), the plunging charge assembly 240*b* may be shifted to the armed (engaged) position as shown in FIGS. 4B and 5B. The plunging charge assembly 240*b* may be shifted by advancement of an adjacent loaded perforating gun 132 through the box 238*a* and into engagement with the endcap assembly 239*a*.

During this advancement, the plunger 344*a*, together with the detonator cord 346*c* and other portions of the plunging charge assembly 240*b* connected thereto, may be pushed downward as indicated by the arrows. The compression mechanism 346*b* is compressed between the plunger 344*a* and the detonator housing 342*a* to dampen movement of the plunging charge assembly 240*b*. The new loaded perforating gun 132 may be advanced against the endcap assembly 239*a* with sufficient force to overcome a spring force of the compression mechanism 346*b* and with sufficient force to drive the plunging charge assembly 240*b* against the detonator assembly 240*a* and into the armed position.

As the plunging charge assembly 240*b* advances a distance downhole, the detonator cord 346*c* within the receiving cap 346*a* is moved into contact with the detonator 342*c*. Also, as the receiving cap 346*a* moves towards the detonator assembly 240*a*, the electrical connection is also made between the electrical wire 331 and the switch assembly 342*e*. The electrical contacts 352*c* extending from the detonator nose 342*b* are moved into electrical contact with the wire 331.

In the armed position as shown in FIGS. 4B and 5B, the electrical signal is now permitted to pass from electrical wire 331, through the plunging charge assembly 240*b*, and to the switch assembly 342*e*. The switch assembly 342*e* may now activate the switch 352*a* and thereby the detonator 342*c*. The detonator 342*c* may then be activated by the switch 352*a* to send the detonation signal through the detonator cord 346*c* and to the shaped charge 136.

The loaded perforating gun 132 may be returned to the disarmed position by removal of the adjacent loaded perforating gun 132. The plunging charge assembly 240*b* with the plunger 344*a* and the detonator cord 346*c* may be pushed back to the disarmed position of FIGS. 4A and 5A by the compression mechanism 346*b* when the adjacent loaded perforating gun 132 is removed. The compression mechanism 346*b* may be used to retract the plunger 344*a* and the plunging charge assembly 240*b* back to their original position after detonation is completed. The compression mechanism 346*b* may now be used to prevent electrical and/or detonation connections until another loaded perforating gun 132 is connected and pushes the plunging charge assembly 240*b* back into the armed position.

While FIGS. 1-5B show examples of features of the loaded perforating gun 132 and its components, additional features that may be included are provided in US Patent Publication No. 20210332678, U.S. patent Ser. No. 11/078,763, U.S. patent Ser. No. 10/858,919, U.S. Patent Application No. 62/717,320, the entire contents of each of which are hereby incorporated by reference herein to the extent not inconsistent with the present disclosure. For example, these incorporated patents show features of switch assemblies, detonators, charge tubes, shape charges, and other components of a perforating tool that may be used with the loaded perforating gun 132. The switch assembly may include, for example, features, such as spring-loaded contacts to facilitate engagement between the switch assembly and the detonator as described in these incorporated patents. The charge assembly and the detonator assembly may include, for example, an offset configuration for one-way receipt of the detonator assembly into the charge assembly as described in these incorporated patents.

Figure 6A:
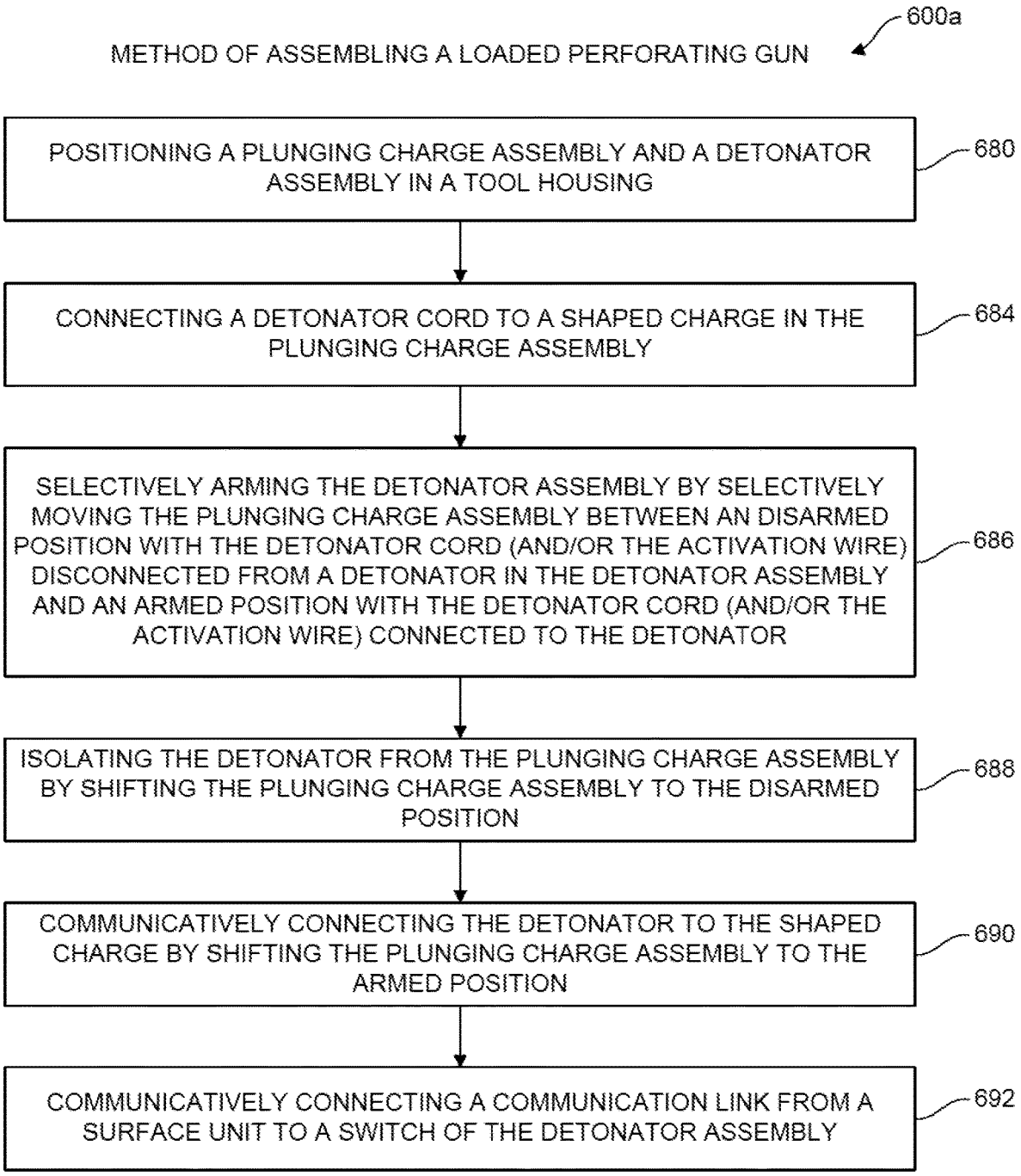
FIGS. 6A and 6B are flowcharts depicting a method of assembling a loaded downhole perforating tool and a method of perforating a wellbore, respectively.
Figure 6B:
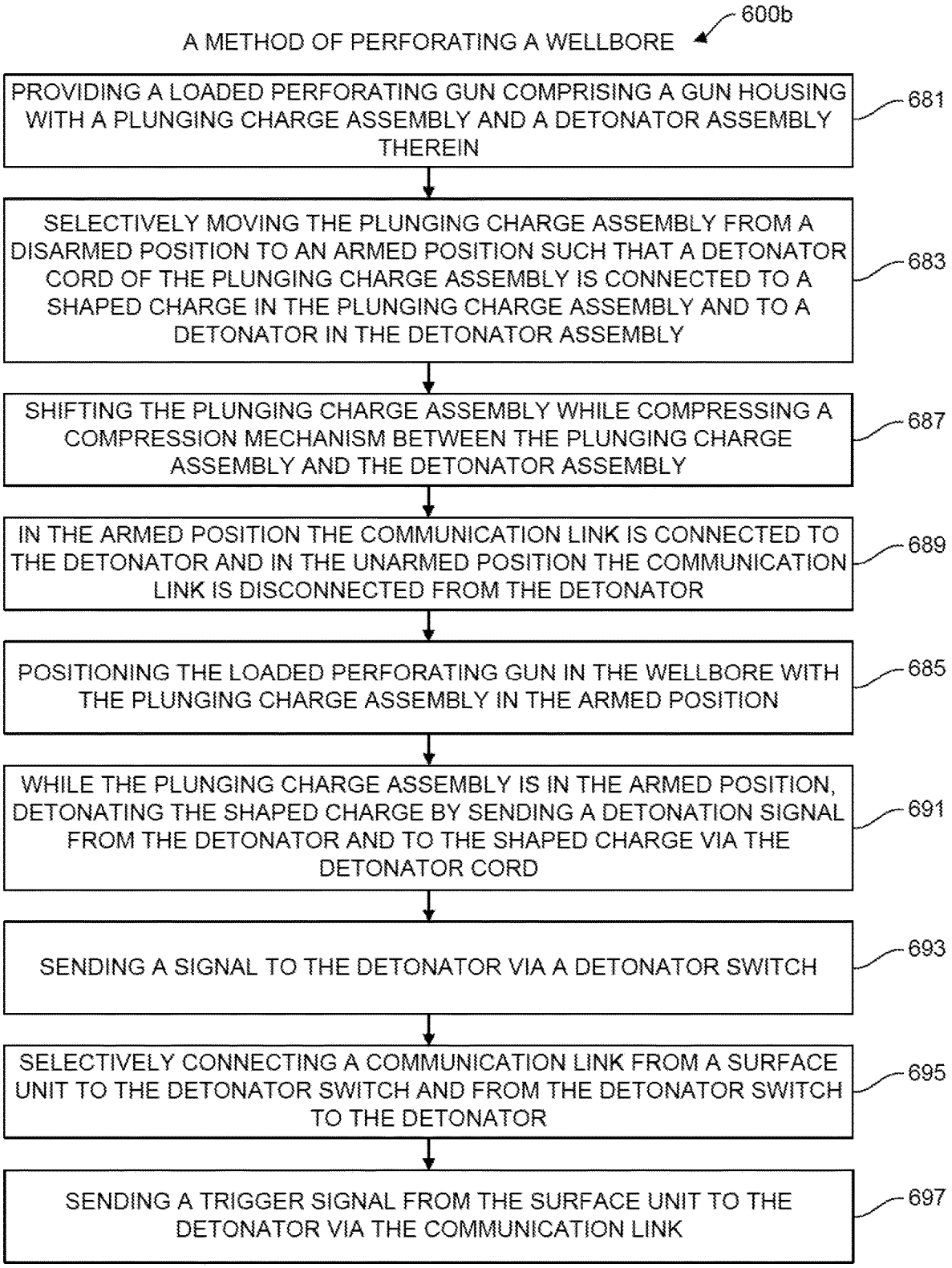

FIGS. 6A and 6B are flowcharts depicting a method 600*a* of assembling a loaded perforating gun and a method 600*b* of perforating a wellbore, respectively. The method 600*a* involves 680—positioning a plunging charge assembly and a detonator assembly in a tool housing, 684—connecting a detonator cord to a shaped charge in the plunging charge assembly.

The method 600*a* further involves 686—selectively arming the detonator assembly by selectively moving the plunging charge assembly between a disarmed position with the detonator cord (and/or the activation wire) disconnected from a detonator in the detonator assembly and an armed position with the detonator cord (and/or the activation wire) connected to the detonator. The selectively arming 686 may involve 688—isolating the detonator from the plunging charge assembly by shifting the plunging charge assembly to the disarmed position and/or 690—communicatively connecting the detonator to the shaped charge by shifting the plunging charge assembly to the armed position. The method 600*a* may also involve 692—communicatively connecting a communication link from a surface unit to a switch of the detonator assembly.

The method 600*b* involves 681—providing a loaded perforating gun comprising a gun housing with a plunging charge assembly and a detonator assembly therein. The method 600*b* continues with 683—selectively moving the plunging charge assembly to an armed position such that the detonator cord of the plunging charge assembly is connected to a shaped charge in the plunging charge assembly and to the detonator in the detonator assembly, and 685—positioning the loaded perforating gun in the wellbore with the plunging charge assembly in the armed position. The 685—selectively moving may involve 687—shifting the plunging charge assembly while compressing a compression mechanism between the plunging charge assembly and the detonator assembly and/or 689—in the armed position the communication link is connected to the detonator and in the disarmed position the communication link is disconnected from the detonator.

The method 600*b* continues with 691—while the plunger assembly is in the armed position, detonating the shaped charge by sending a detonation signal from the detonator to the shaped charge via the detonator cord. The activating the detonator comprises 693—sending a signal to the detonator via a detonator switch. The method 600*b* continues with 695—selectively connecting a communication link from a surface unit to the detonator switch and from the detonator switch to the detonator and 697—sending a trigger signal from the surface unit to the detonator via the communication link.

One or more portions of the methods may be optional. Portions of the method may be performed in various orders, and part or all may be repeated.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features and/or methods provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter. For example, while certain components are provided herein, it will be appreciated that various forms of such components may be provided. While the figures herein depict a specific configuration or orientation, these may vary. First and second are not intended to limit the number or order.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. A loaded perforating gun positionable in a wellbore penetrating a subterranean formation, the loaded perforating gun comprising:

a gun housing;

a detonator assembly positioned in the gun housing, the detonator assembly comprising a detonator and a detonation switch; and a plunging charge assembly positioned in the gun housing, the plunging charge assembly comprising:

a charge tube, a shaped charge supported in the charge tube, and a plunger comprising a receiving cap and a detonator cord, the receiving cap connected to the charge tube, the detonator cord supported in the receiving cap, the shaped charge operatively connected to the detonator cord;

wherein the plunging charge assembly is selectively movable between a disarmed position with the detonator cord disconnected from the detonator assembly and an armed position with the detonator cord operatively connected to the detonator of the detonator assembly whereby the detonator can selectively pass a detonation signal to the shaped charge; and wherein the plunger further comprises a compression mechanism.

2. The loaded perforating gun of claim 1, wherein the detonator assembly comprises a detonator housing, the compression mechanism compressible between the plunging charge assembly and the detonator housing.

3. The loaded perforating gun of claim 1, further comprising a bulkhead assembly at one end of the gun housing and an endcap at an opposite end of the gun housing.

4. The loaded perforating gun of claim 3, wherein the bulkhead assembly is connected to the detonator assembly.

5. The loaded perforating gun of claim 3, wherein the endcap is connected to the plunging charge assembly.

6. The loaded perforating gun of claim 1, wherein the detonation switch is communicatively connected to the detonator and a surface unit to pass activation signals therebetween.

7. The loaded perforating gun of claim 1, wherein the detonator assembly further comprises a detonator housing and a detonator nose, the detonator supported in the detonator housing and the detonator nose.

8. The loaded perforating gun of claim 7, wherein the detonator nose supports the detonator therein, the detonator nose extendable into the receiving cap and slidably movable about the receiving cap for selective engagement between the detonator and the detonator cord.

9. A downhole perforating tool positionable in a wellbore penetrating a subterranean formation, the downhole perforating tool comprising:

a tool housing; and a loaded perforating gun positionable about the tool housing, the loaded perforating gun comprising:

a gun housing;

a detonator assembly positioned in the gun housing, the detonator assembly comprising a detonator and a detonation switch; and a plunging charge assembly positioned in the gun housing, the plunging charge assembly comprising:

a charge tube, a shaped charge supported in the charge tube, and a plunger comprising a receiving cap and a detonator cord, the receiving cap connected to the charge tube, the detonator cord supported in the receiving cap, the shaped charge operatively connected to the detonator cord;

wherein the plunging charge assembly is selectively movable between a disarmed position with the detonator cord disconnected from the detonator assembly and an armed position with the detonator cord operatively connected to the detonator of the detonator assembly whereby the detonator can selectively pass a detonation signal to the shaped charge; and wherein the plunger further comprises a compression mechanism.

10. The downhole perforating tool of claim 9, wherein the detonator assembly comprises a detonator housing, the compression mechanism compressible between the plunging charge assembly and the detonator housing.

11. A method of assembling a downhole perforating gun, comprising:

positioning a plunging charge assembly and a detonator assembly in a tool housing;

connecting a detonation cord between a plunger of the plunging charge assembly and a shaped charge in the plunging charge assembly; and selectively arming the detonator assembly by selectively moving the plunging charge assembly between a disarmed position with the detonator cord disconnected from a detonator in the detonator assembly and an armed position with the detonator cord connected to the detonator;

wherein the selectively arming the detonator comprises shifting the plunging charge assembly to the disarmed position such that the detonator is isolated from the plunging charge assembly.

12. The method of claim 11, wherein the selectively arming the detonator assembly comprises selectively moving the detonator into contact with the detonator assembly by compressing the plunger against the detonator assembly.

13. The method of claim 11, wherein the selectively arming the detonator assembly comprises communicatively connecting the detonator to the shaped charge by shifting the plunging charge assembly to the armed position.

14. The method of claim 11, further comprising communicatively connecting a communication link from a surface unit to a switch of the detonator assembly.

15. A method of perforating a wellbore, comprising:

providing a loaded perforating gun comprising a gun housing with a plunging charge assembly and a detonator assembly therein, the detonator assembly comprising a detonator;

shifting the plunging charge assembly to a disarmed position such that the detonator is isolated from the plunging charge assembly;

selectively moving the plunging charge assembly from the disarmed position to an armed position such that, in the armed position, a detonator cord in the plunging charge assembly is connected to a shaped charge in the plunging charge assembly and to a detonator in the detonator assembly;

positioning the loaded perforating gun in the wellbore with the plunging charge assembly in the armed position; and while the plunging charge assembly is in the armed position, detonating the shaped charge by sending a detonation signal from the detonator and to the shaped charge via the detonator cord.

16. The method of claim 15, further comprising selectively connecting a communication link from a surface unit to a detonator switch and from the detonator switch to the detonator.

17. The method of claim 16, wherein, in the armed position, the communication link is connected to the detonator and in the disarmed position the communication link is disconnected from the detonator.

18. The method of claim 16, further comprising sending a trigger signal from the surface unit to the detonator via the communication link.

19. The method of claim 15, wherein the selectively moving the plunging charge assembly comprises shifting the plunging charge assembly while compressing a compression mechanism between the plunging charge assembly and the detonator assembly.

20. A loaded perforating gun positionable in a wellbore penetrating a subterranean formation, the loaded perforating gun comprising:

a gun housing;

a detonator assembly positioned in the gun housing, the detonator assembly comprising a detonator and a detonation switch; and a plunging charge assembly positioned in the gun housing, the plunging charge assembly comprising:

a charge tube, a shaped charge supported in the charge tube, and a plunger comprising a receiving cap and a detonator cord, the receiving cap connected to the charge tube, the detonator cord supported in the receiving cap, the shaped charge operatively connected to the detonator cord;

wherein the plunging charge assembly is selectively movable between a disarmed position with the detonator cord disconnected from the detonator assembly and an armed position with the detonator cord operatively connected to the detonator of the detonator assembly whereby the detonator can selectively pass a detonation signal to the shaped charge; and wherein the detonator assembly further comprises a detonator housing and a detonator nose, the detonator supported in the detonator housing and the detonator nose.

21. The loaded perforating gun of claim 20, wherein the detonator nose supports the detonator therein, the detonator nose extendable into the receiving cap and slidably movable about the receiving cap for selective engagement between the detonator and the detonator cord.

22. A downhole perforating tool positionable in a wellbore penetrating a subterranean formation, the downhole perforating tool comprising:

a tool housing; and a loaded perforating gun positionable about the tool housing, the loaded perforating gun comprising:

a gun housing;

a detonator assembly positioned in the gun housing, the detonator assembly comprising a detonator and a detonation switch; and a plunging charge assembly positioned in the gun housing, the plunging charge assembly comprising:

a charge tube, a shaped charge supported in the charge tube, and a plunger comprising a receiving cap and a detonator cord, the receiving cap connected to the charge tube, the detonator cord supported in the receiving cap, the shaped charge operatively connected to the detonator cord;

wherein the plunging charge assembly is selectively movable between a disarmed position with the detonator cord disconnected from the detonator assembly and an armed position with the detonator cord operatively connected to the detonator of the detonator assembly whereby the detonator can selectively pass a detonation signal to the shaped charge; and wherein the detonator assembly further comprises a detonator housing and a detonator nose, the detonator supported in the detonator housing and the detonator nose.

23. The downhole perforating tool of claim 22, wherein the detonator nose supports the detonator therein, the detonator nose extendable into the receiving cap and slidably movable about the receiving cap for selective engagement between the detonator and the detonator cord.

* * * * *